US005755531A

United States Patent [19]

Ribas Ferreira et al.

[11] Patent Number: 5,755,531

[45] Date of Patent: May 26, 1998

[54] TRANSFER SYSTEM FOR PRODUCTS AND UTILITIES

[75] Inventors: Paulo Paz Ribas Ferreira, Petropolies; Cesar De Souza Lima; Marco Antonio Nogueira Herdeiro, both of Rio de Janeiro, all of Brazil

[73] Assignee: Petroleo Brasileiro S.A.-Petrobras, Brazil

[21] Appl. No.: 774,212

[22] Filed: Dec. 27, 1996

[30] Foreign Application Priority Data

Mar. 27, 1996 [BR] Brazil ..... PI 9601144-0

[51] Int. Cl.[6] ..... F16L 1/04; E02B 17/01

[52] U.S. Cl. ..... 405/169; 141/389; 166/359; 405/195.1

[58] Field of Search ..... 405/158, 165–173, 405/195.1, 224; 166/359; 137/362; 141/386, 387, 388

[56] References Cited

U.S. PATENT DOCUMENTS

| | | | |
|---|---|---|---|
| 3,430,670 | 3/1969 | Hopkins | 141/387 |
| 4,182,584 | 1/1980 | Panickev et al. | 405/195.1 |
| 4,400,109 | 8/1983 | Gentry et al. | 405/169 X |
| 4,448,569 | 5/1984 | Gentry et al. | 405/169 |

FOREIGN PATENT DOCUMENTS

| | | |
|---|---|---|
| 0 371 669 | 6/1990 | European Pat. Off. . |
| 2 220 453 | 1/1990 | United Kingdom . |
| 2 298 175 | 8/1996 | United Kingdom . |

*Primary Examiner*—Dennis L. Taylor

*Attorney, Agent, or Firm*—Cushman Darby & Cushman Intellectual Property Group of Pillsbury Madison & Sutro, LLP

[57] ABSTRACT

The present invention relates to a system which makes use of a multiple reel on which groups of flexible lines supported by articulated structures (8, 9) are wound. The groups of flexible lines are interconnected at one end to flexible production and utility lines (4) emerging from the seabed and, at the other end, to connection blocks (10, 11) which may be connected to connection plates (15, 16, 17, 18) on at least one connection tower (13, 14) fixed to the vessel. As the connections are redundant, it is always possible to reposition one group of flexible lines while another group is connected, which gives the transfer system (2) total freedom of movement.

3 Claims, 4 Drawing Sheets

TRANSFER SYSTEM FOR PRODUCTS AND UTILITIES

FIELD OF THE INVENTION

The present invention relates to a system for transferring fluids, electricity, or an optical signal between two bodies between which there is relative movement. More specifically, it relates to a system which makes it possible to transfer, between a vessel and petroleum wells or manifolds or pipelines located on the seabed or a second vessel, hydrocarbons and utilities whose origin or destination is a vessel or a platform.

PRIOR ART

One form of system used to discharge offshore petroleum production does so via a vessel which is anchored at a single point but has the ability to turn around it. This vessel, generally a ship, receives the petroleum via submerged lines which run to it. After passing through the processing plant, the petroleum is then stored in tanks on board the vessel until such time as it is transferred to a collection point which may, for example, be a petroleum carrier which will transport it to land. The discharge of the petroleum to the vessel is one of the critical points in this operation since, if the vessel can turn about a point, it is necessary to hove a mechanical device which prevents the submerged lines from twisting excessively.

Two alternatives hove been used to achieve this transfer without twisting. One of them consists of a group of rotary joints, split in two, which are stacked vertically one upon the other and permit a fluid, electricity, or an optical signal to pass through each of them in one direction or the other. The rotary joints for fluid have packing rings between the two parts which are able to rotate with respect to each other, for maintaining permanent contact. This type of rotary joint is known by specialists as a "swivel". This alternative has the major advantage of making it possible for the vessel to be able to turn freely about the anchoring point without affecting production. However, it does have the drawback of requiring the use of dynamic seals, which always present a risk of leakage.

A further alternative consists of a system formed basically of a horizontal reel on which flexible lines are wound, these being connected at one end to the lines fixed to the vessel and at the other end to the lines which run via the central part of the reel and originate from the anchoring tower. The flexible lines on the reel are aligned vertically one upon the other inside an articulated structure which is unwound or rewound as the vessel turns, in one direction or the other, about the anchoring point. This system has the advantage of avoiding the use of dynamic seals, but it imposes a serious restriction on the vessels ability to turn, which is, generally speaking, limited to ±270°.

The present invention aims to provide a novel solution to the problem of transferring products and utilities, and consists of a refinement of the reel alternative, incorporating into it the advantage of unlimited turning ability offered by the stacked swivel system, and also other features which make this invention highly attractive.

SUMMARY OF THE INVENTION

The object of the present invention is to provide a system which can be used to transfer fluids and utilities between a vessel and the seabed or to another vessel or a platform.

This object is achieved by a transfer system for products and utilities, comprising a structure in the form of a multiple reel with a cylindrical central opening, and at least two groups of flexible lines supported by articulated structures and wound around the multiple reel, each said group occupying one of the reels; wherein each group of flexible lines is interconnected at one of its ends to a wall located in the central region of the multiple reel, where the terminals of the rigid lines and cables which are extensions of the production and utility lines are located; wherein at its other end, each group of flexible lines is connected to a respective one of a set of circumferentially spaced connection blocks which are able to move along roils; and wherein the said groups of flexible lines provide different flow paths, in parallel, from the production and utility lines to the connection blocks.

A system of this type is formed basically by a multiple reel fixed horizontally on top of a cylindrical anchoring tower interconnected to the vessel and by groups of flexible lines wound on each of the reels. Each group of flexible lines runs inside an articulated structure which supports the lines individually and reduces the forces which act on them as a result of movement of the lines on the multiple reel as the vessel turns about the axis of the cylindrical anchoring tower, coincident with the axis of the multiple reel.

Each group of lines is held at one end on a connection block which can move on rails arranged as a circular track at the periphery of the multiple reel. When a connection block is coupled to a connection plate held on a connection tower, it is forced to follow the circular movement of the plate which moves together with the vessel.

The cylindrical anchoring tower has rotational freedom of movement with respect to the vessel. These groups of flexible lines are redundant and may be connected to connection plates, on at least one connection tower fixed to the vessel, via connection blocks mounted on rails, which gives the group total freedom of rotation.

When the block is uncoupled from the plate it can then, through the action of a motor installed in it, move together with the group of flexible lines for which it serves as the terminal, until these lines are repositioned in a more suitable configuration. The coupling between the block and the plate in front of it can then be made.

When this has been done, action may be carried out on the valves which transfer production flow and the flow of utilities to the group of recently connected lines, and then the other connection block can be uncoupled. The connection blocks, the plates, and the connection towers hove valves and facilities which permit the operations of connecting, disconnecting and testing the seal of the connections.

BRIEF DESCRIPTION OF THE INVENTION

The invention will now be described in greater detail with reference to the accompanying drawings which are given purely by way of illustration, and in which.

DESCRIPTION OF A PREFERRED EMBODIMENT

Figure 1:
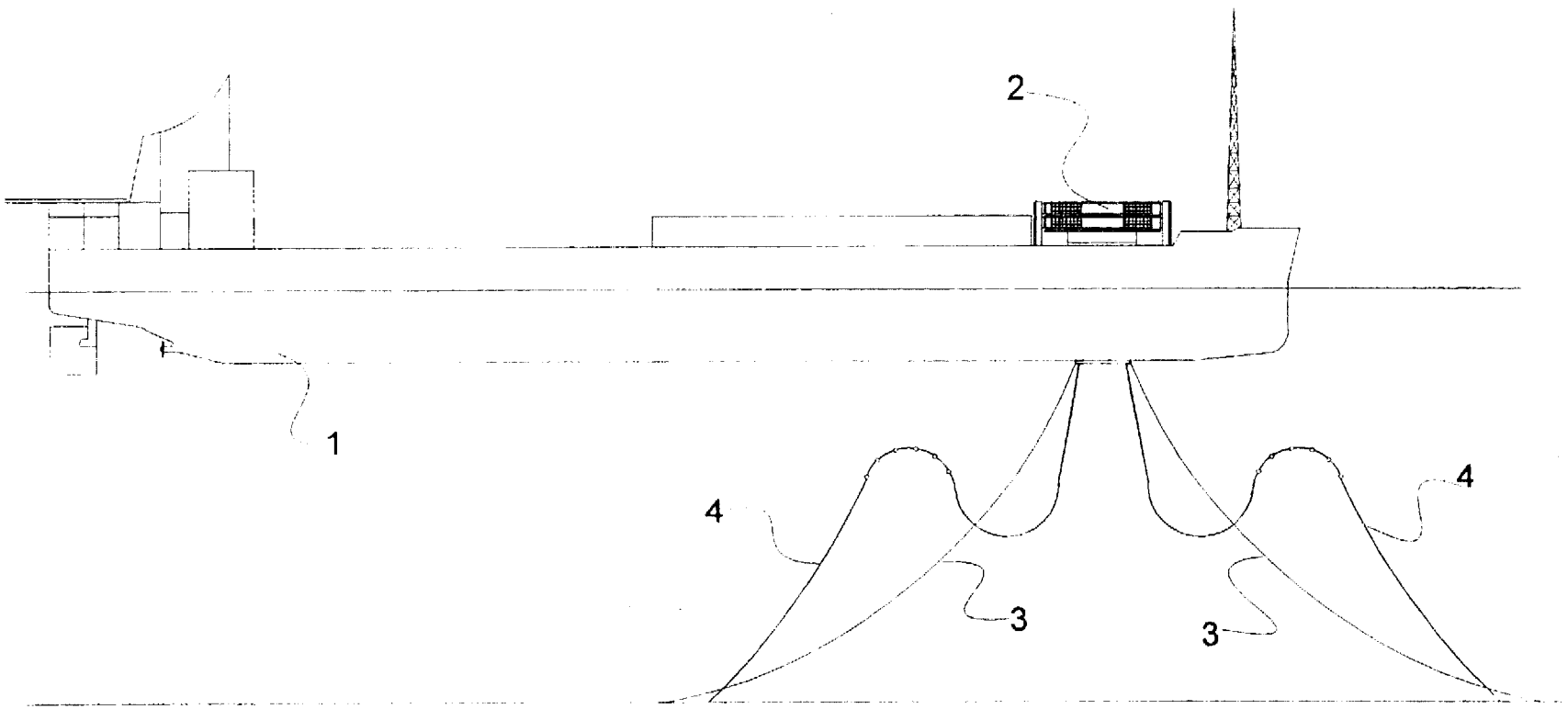
FIG. 1 is a side elevational view of a floating vessel for the offshore production, storage and discharge of petroleum, and which uses the transfer system of the present invention.

FIG. 1 shows a vessel (1) with the system (2) in accordance with the present invention for transferring products and utilities. In this embodiment, the transfer system is shown located at the bows of a ship. Although this is a satisfactory location it should not be regarded as a limitation on the use of the system of the present invention, since this may be used at any location on a vessel.

FIG. 1 also shows anchoring lines (3) and the production and utility lines (4) which are interconnected to the transfer system (2). Fluids, electricity, and optical signals are able to pass through the production and utility lines (4). The interconnection between the flexible production and utility lines (4) and the transfer system (2) is achieved by means of rigid lines which, for the sake of simplification and also because they do not form part of the present invention, are not shown in FIG. 1.

Figure 2:
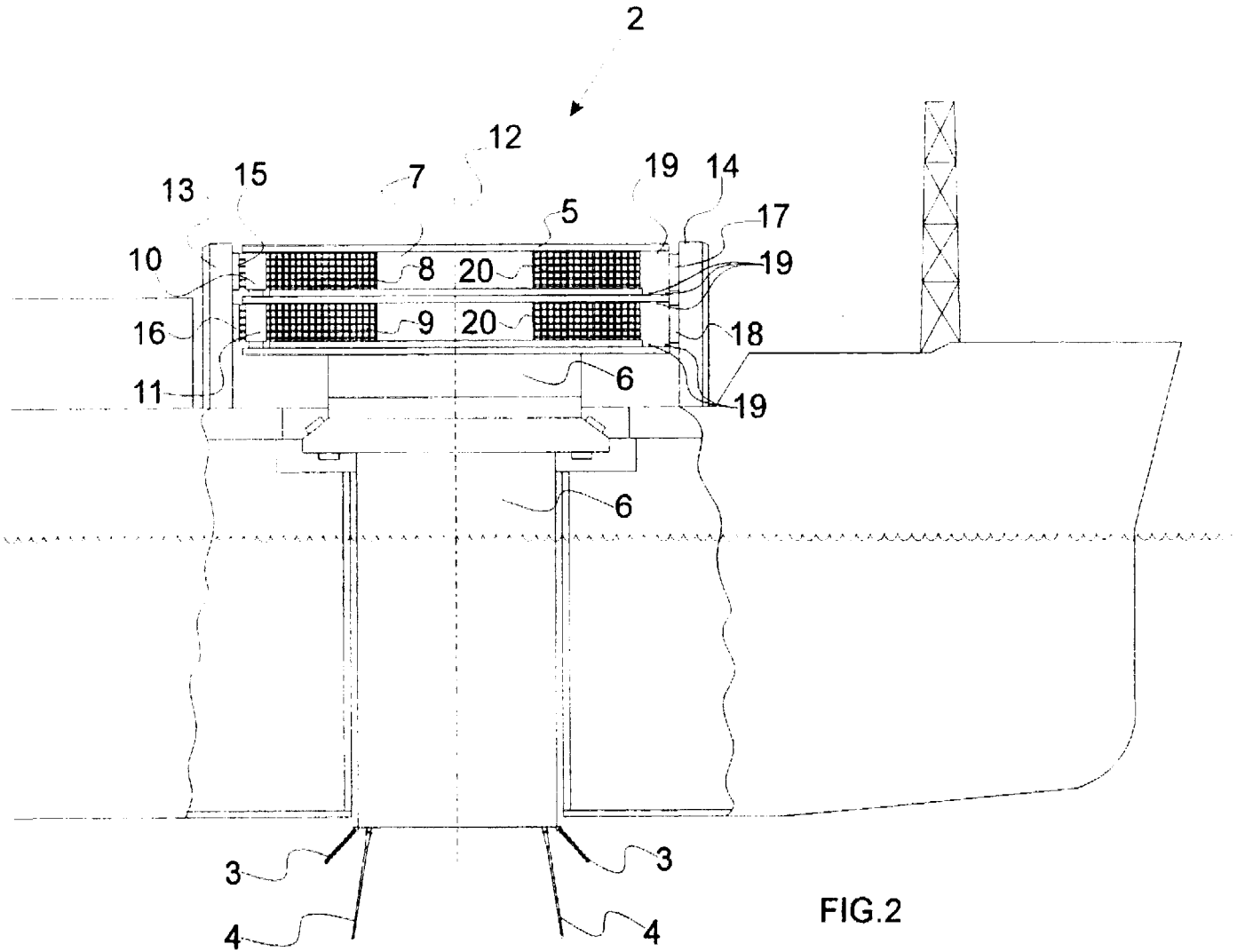
FIG. 2 is a more detailed side elevation of the same system, showing the cylindrical anchoring tower and, above it, the transfer system with a double reel and two connection towers.

FIG. 2 shows the transfer system (2) in greater detail it is possible to see the multiple reel (5), which, in the present preferred embodiment, is a double reel.

The multiple reel (5) is fixed directly to and coaxially on the cylindrical anchoring tower (6). In FIG. 2 this imaginary axis is represented by the line (12). The multiple reel (5) has a cylindrical opening (7) in its central part. Depending on the diameters of the transfer system (2) and of the anchoring tower (6) it is possible to carry out through this opening appropriate operations, involving underwater equipment. The cylindrical anchoring tower (6) has total rotational freedom of movement with respect to the vessel.

Groups of flexible lines run inside articulated structures (8, 9) which are similar in nature to bicycle chains. In addition to supporting the groups of flexible lines, these structures reduce the loads acting on them as a result of the turning of the vessel. The two groups of flexible lines can be wound on or unwound from the multiple reel (5), depending on the relative rotational movements between the vessel and the cylindrical anchoring tower (6).

The groups of flexible lines supported by the structures (8, 9) are each connected at one of its ends to the cylindrical wall (20) located in the central region of the multiple reel (5) where the ends of the rigid lines and the terminal which interconnect to the flexible production and utility lines (4) are located.

At the other end, each group of flexible lines is connected to the respective connection block (10, 11) which runs on rails (19). These rails are arranged in circles whose axis of symmetry coincides with the vertical axis (12), thus keeping the path of movement of each connection block (10, 11) constantly circular and at the some distance from the vertical axis (12).

Figure 3:
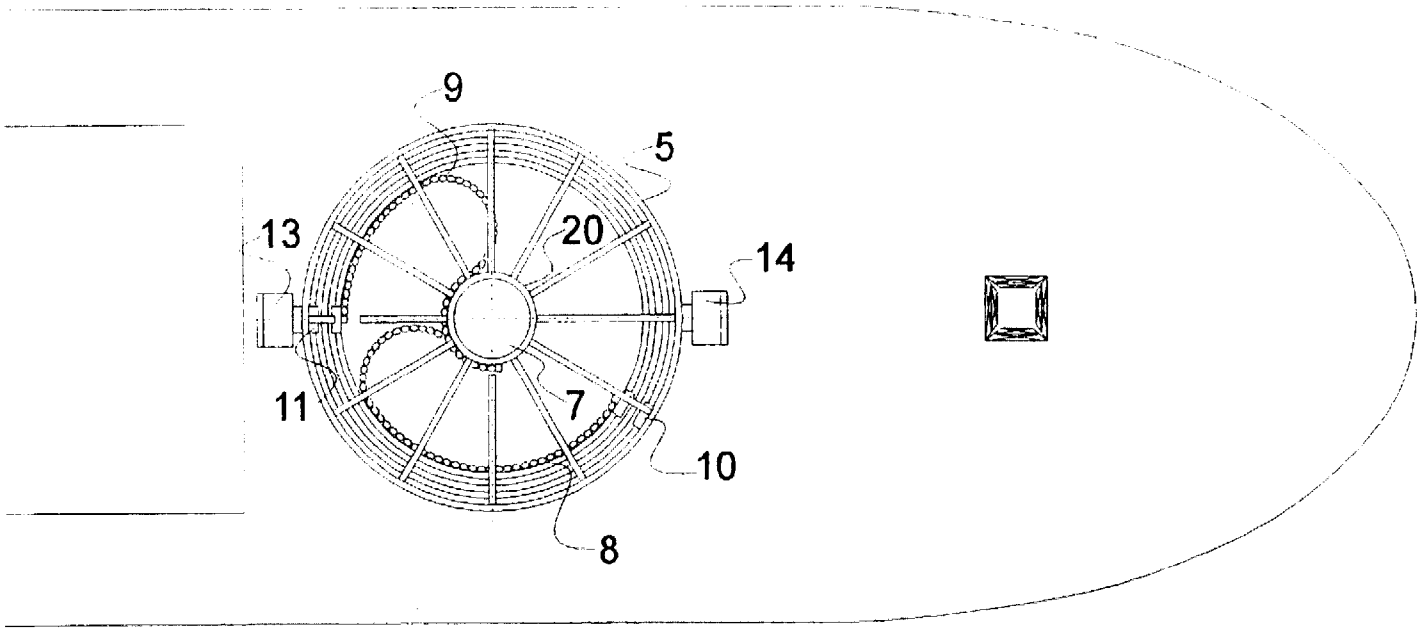
FIG. 3 is a top plan view showing the transfer system with one of the groups of flexible lines with its associated connection block in the intermediate position on the track and the other group in the uncoupled and stationary state.
Figure 4:
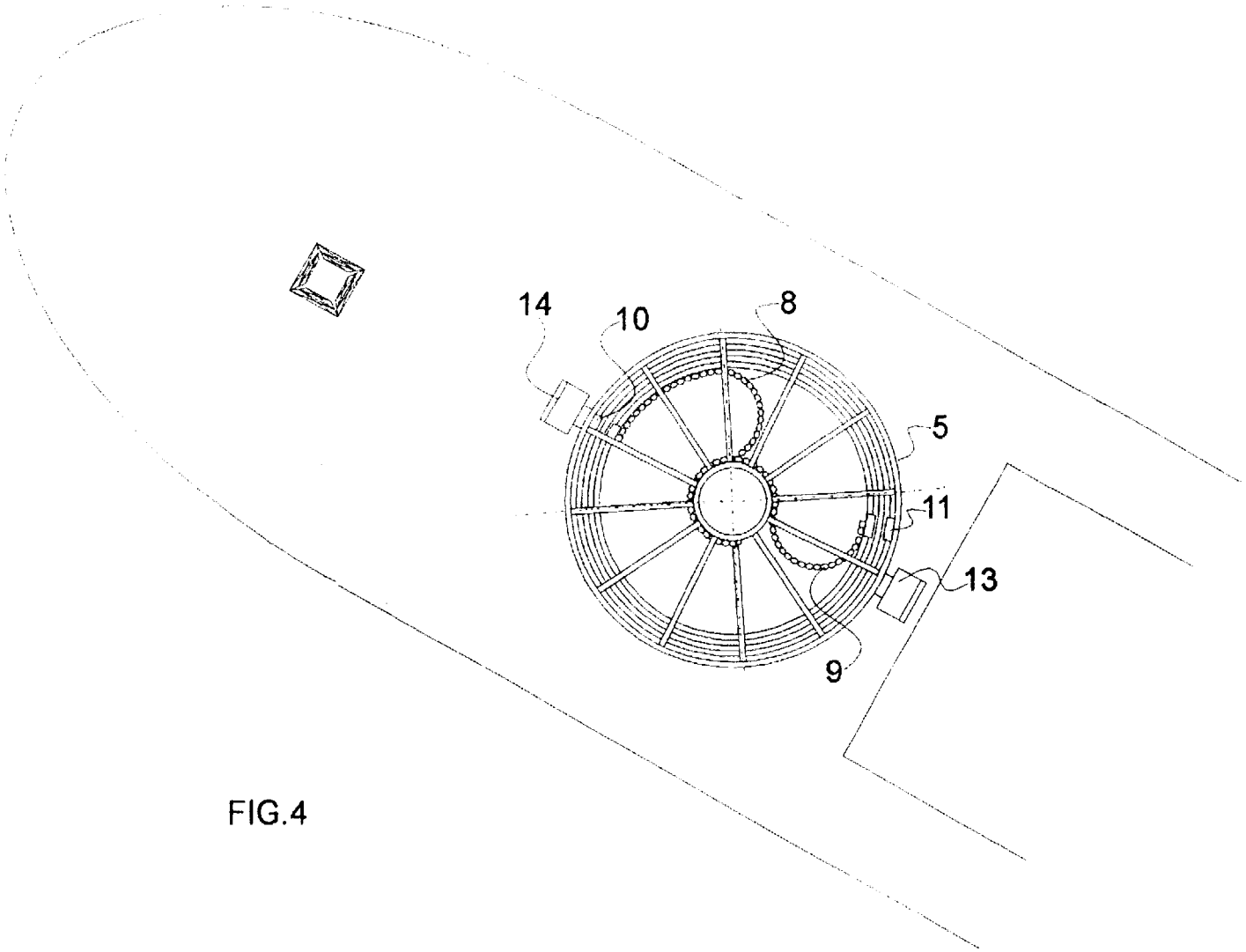
FIG. 4 shows the vessel, after a turn of almost 220° clockwise with respect to the position shown in FIG. 3, where the group of lines shown disconnected in FIG. 3 is now shown connected, and the group of lines which is connected in FIG. 3 is now shown disconnected

The connection blocks (10, 11) may be connected to connection plates on connection towers (13, 14) fixed directly to the vessel and integral with it. In the present embodiment, in order to extend the rotational path of the transfer system of the invention, there are two connection towers (13, 14) arranged in diametrically opposed positions, as shown in FIGS. 2, 3 and 4. It is, however, possible to use any other number of connection towers, depending on the peculiarities of each situation.

As the groups of flexible lines supported by the articulated structures (8, 9) are wound on the multiple reel (5) at different levels, the first being above the second, in this case with the first at the top and the second at the bottom, the connection towers (13, 14) hove connection plates located at different levels so as to make it possible to achieve perfect coupling of the connection towers (13, 14) to the connection blocks (10, 11).

In this way, in the present embodiment, the connection block (10) can be coupled to the connection tower (13) by means of the connection plate (15), or to the connection tower (14) by means of the connection plate (17). Also the connection block (11) may be coupled to the connection tower (13) by means of the connection plate (16), or to the connection tower (14) by means of the connection plate (18).

All the connection blocks and plates are designed so as to guarantee that, when the couplings are made, the flows in the flexible production and utility lines (4) are correctly conveyed to the intended points by the flexible lines supported by the articulated structures (8, 9). In other words, it must for example, be guaranteed that the flow of oil originating from an underwater well or from an underwater manifold is correctly conveyed to the primary processing plant.

The connections effected by the groups of flexible lines linked to the connection blocks (10, 11) are redundant. It is therefore possible, while the vessel is making angular movements about the axis of the multiple reel (5), to reposition one group of flexible lines while the other group is disconnected, without adversely affecting production or other essential functions.

FIG. 3 shows a top plan view of the transfer system (2) of the present invention. The articulated structures (8, 9) which support the groups of flexible lines are in different positions. Each connection block (10, 11) can be coupled to any one of the connection towers (13, 14), depending on what is appropriate at the time the connection is made.

The connection plates (15, 16, 17, 18) of the towers (13, 14) may be actuated remotely, to move radially toward the multiple reel, so as to permit their connection to the connection block (10, 11) with which they are associated. When clamping has been carried out, the seal at the connections of the lines where the oil and gas flow may be tested using procedures in general use in the petroleum industry.

After carrying out these tests, the production flow and utilities can be switched over in order to pass through the recently made connections. It is then possible to proceed with uncoupling the connection block which was hitherto connected, with the aim of giving the transfer system a larger rotational path. However, before carrying out this uncoupling, it is necessary to drain the fluids retained between the shut-off valves (not shown), thereby preventing leakage into the environment during disconnection. These drainage procedures are not described here because they will be familiar to specialists and also because they are not included within the scope of the invention.

The ability of the connection blocks (10, 11) to move on the rails (19) makes it possible to carry out the actions necessary for coupling the connection blocks (10, 11) to the connection plates (15, 16, 17, 18). In the present embodiment, a motor is installed in the blocks to provide the necessary mechanical power to move them over the rails (19); this may, for example, be a hydraulic or electric motor.

The connection blocks (10, 11), the connection plates (15, 16, 17, 18), and the connection towers (13, 14) have valves which permit the operations of connecting, disconnecting and testing the seal of the connections.

The use of groups of flexible lines interconnected to connection blocks and connection towers with multiple connection plates gives the transfer system of the present invention great flexibility, since it ensures that, at any moment, there will always be at least one connection in operation, regardless of the position of the vessel.

We claim:

1. A transfer system (2) for products ad utilities, characterized in that it comprises a structure in the form of a multiple reel (5) with a cylindrical central opening (7), and at least two groups of flexible lines supported by articulated structures (8, 9) and wound around the multiple reel (5), each said group occupying one of the reels; in that each group of flexible lines is interconnected at one of its ends to a wall (20) located in the central region of the multiple reel (5), where the terminals of the rigid lines and cables which are extensions of the production and utility lines (4) are located; in that at its other end, each group of flexible lines is connected to a respective one of a set of circumferentially spaced connection blocks (10, 11) which are able to move along rails (19); and in that the said groups of flexible lines provide different flow paths, in parallel, from the production and utility lines (4) to the connection blocks (10, 11).

2. A transfer system according to claim 1, wherein the connection blocks (10, 11) are able to be coupled to connection plates (15, 16, 17, 18) on at least one connection tower (13, 14).

3. A transfer system according to claim 2, wherein the connection plates (15, 16, 17, 18) are able to be actuated remotely to move radially inwardly of the multiple reel to make it possible to connect them to the connection block with which they are associated.

* * * * *